US005628269A

United States Patent [19]

Henmi et al.

[11] Patent Number: 5,628,269

[45] Date of Patent: May 13, 1997

[54] JUMP PUMP ARRANGEMENT FOR JET BOAT

[75] Inventors: Yasuhiko Henmi; Makoto Nagafusa; Susumu Yamazaki, all of Hamamatsu, Japan

[73] Assignee: Sanshin Kogyo Kabushiki Kaisha, Hamamatsu, Japan

[21] Appl. No.: 564,655

[22] Filed: Nov. 29, 1995

[30] Foreign Application Priority Data

Dec. 1, 1994 [JP] Japan ..... 6-298340

[51] Int. Cl.[6] ..... B63B 13/00

[52] U.S. Cl. ..... 114/183 R; 114/270

[58] Field of Search ..... 114/270, 183 R, 114/184, 185; 440/38, 39, 40–42, 113; 137/216, 216.2, 217

[56] References Cited

U.S. PATENT DOCUMENTS

| | | | |
|---|---|---|---|
| 758,188 | 4/1904 | Miller | 137/216 |
| 878,424 | 4/1908 | Renton | 137/216.2 |
| 3,060,882 | 10/1962 | Peters et al. | 114/185 |
| 4,787,328 | 11/1988 | Inoue | 114/183 R |
| 4,850,908 | 7/1989 | Nakase et al. | 114/183 R |
| 5,366,397 | 11/1994 | Suganuma et al. | 114/183 R |

*Primary Examiner*—Edwin L. Swinehart

*Attorney, Agent, or Firm*—Knobbe, Martens, Olson & Bear, LLP

[57] ABSTRACT

A water-removal assembly for removing accumulated water from the bilge of a hull of a watercraft that includes a jet propulsion unit with an impeller. The water-removal assembly includes a water pickup provided in the engine compartment. A means for removing water from the engine compartment and preventing water from entering and syphoning into the engine compartment is connected to the water filter by a first conduit. The conduit connects the water removing and preventing means to a water discharge point in the jet propulsion unit so that water is pumped from the bilge. The water removing and preventing means includes a check valve that allows water to flow in one direction so that water is prevented from entering the bilge. A weep hole is provided in the water removing and preventing means to prevent syphoning from occurring in the water-removal assembly.

6 Claims, 4 Drawing Sheets

JUMP PUMP ARRANGEMENT FOR JET BOAT

BACKGROUND OF THE INVENTION

This invention relates to an assembly for removing water from the bilge of a watercraft and, more particularly, to an assembly that removes water from the bilge of a watercraft and prevents water from entering the bilge through the water removal assembly.

Most types of watercraft include a separator or bulkhead for separating an engine compartment and bilge of a watercraft from a propulsion unit that the engine drives. The separator is often provided with seals where a propeller shaft intersects the separator. The separator and seals are designed to prevent water from entering the engine compartment and bilge and interfering with the performance of the watercraft. Unfortunately, water tends to find its way into the bilge, regardless of the separator and sealing arrangement provided. Thus, many watercraft are provided with a pumping arrangement for pumping water out of the engine compartment.

A mechanical pump is not needed if water is removed from the engine compartment and introduced by a venturi pump formed by a jet propulsion unit. The impeller draws water through the jet propulsion unit and discharges the water through a discharge nozzle. By transferring water from the engine compartment and introducing it at an appropriate point in the jet unit, a vacuum is created, and the negative pressure formed therefrom creates a pressure difference so that water flows from an area of high pressure in the engine compartment to this area of lower pressure, eliminating the need for a mechanical pump.

A problem with these water removal assemblies is that instead of removing water as designed, sometimes these water removal assemblies provide a means for allowing water to enter the bilge. This may occur if conditions create a syphoning effect so that water is suctioned into the engine compartment or when a reverse-thrust bucket is engaged for reversing the direction of the watercraft by reversing the flow of the water discharge so that water may be forced through the water removal assembly and into the engine compartment.

When a reverse-thrust bucket is engaged to reverse or retard movement of the watercraft, the pressure in the jet pump may rise and can result in water flowing back through the water removal system and into the bilge.

It is, thus, an object of the present invention to provide a water removal assembly that has a construction that prevents water from entering the bilge through the water removal assembly. This is done by providing a check valve in the water removal assembly that allows water to be removed from the engine compartment, but prevents water from flowing and/or syphoning into the engine compartment. Along with the check valve, a weep hole in the water removal assembly provides additional protection against syphoning of water into the engine compartment.

SUMMARY OF THE INVENTION

A water-removal assembly for removing accumulated water from the bilge of a hull of a watercraft that includes a jet propulsion unit with an impeller, The water-removal assembly includes a water pickup provided in the engine compartment, A means for removing water from the engine compartment and preventing water from entering and syphoning into the engine compartment is connected to the water filter by a conduit, The conduit connects the water removing and preventing means to a water discharge point in the jet propulsion unit so that water is pumped from the bilge, The water removing and preventing means includes a check valve that allows water to flow in one direction so that water is prevented from entering the bilge, A weep hole is provided in the water removing and preventing means to prevent syphoning from occurring in the water-removal assembly.

DETAILED DESCRIPTION OF THE PREFERRED EMBODIMENT

Figure 1:
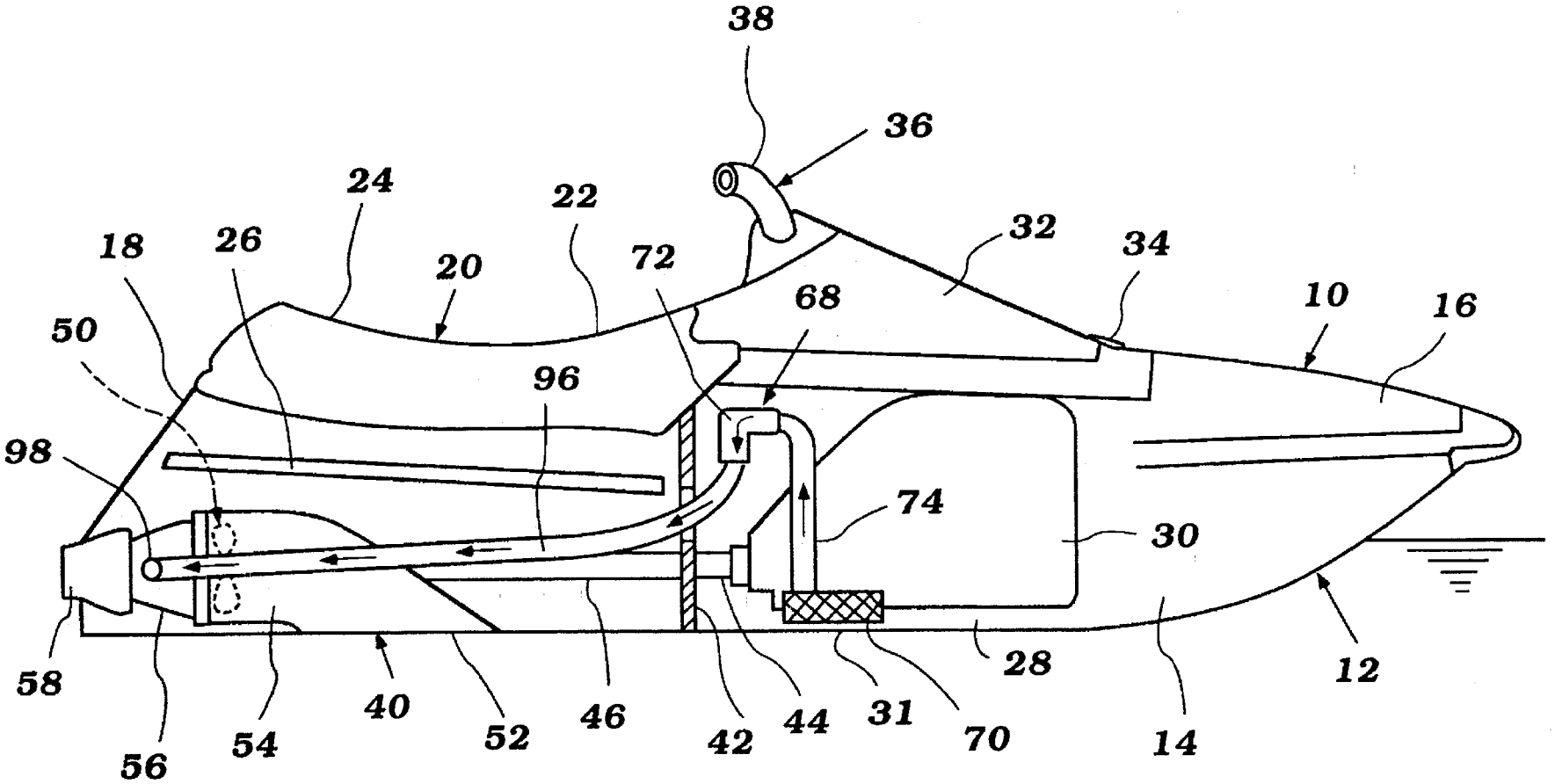
FIG. 1 is a side elevational view of a watercraft constructed in accordance with an embodiment of the invention.
Figure 2:
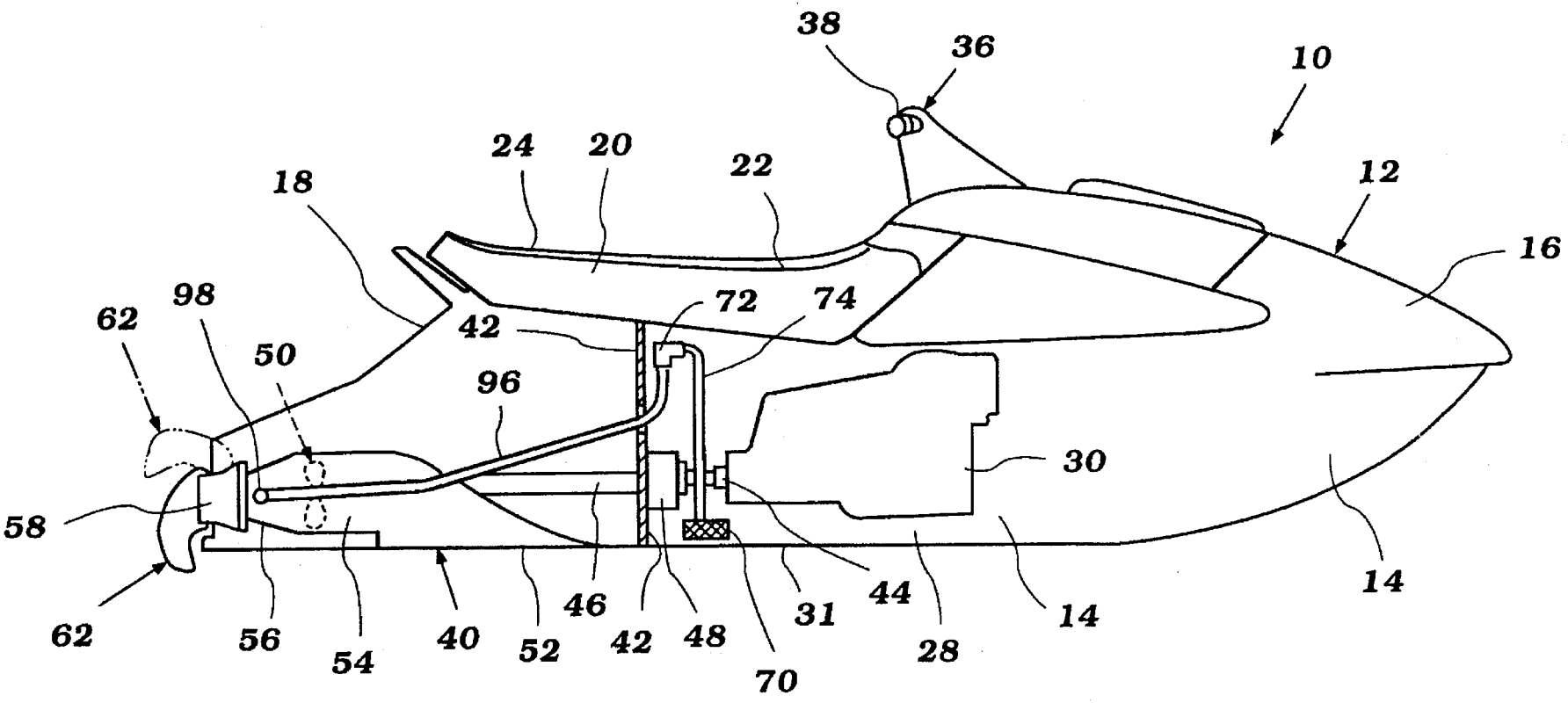
FIG. 2 is a side elevational view of a watercraft constructed in accordance with a second embodiment of the invention, similar to the embodiment in FIG. 1.
Figure 3:
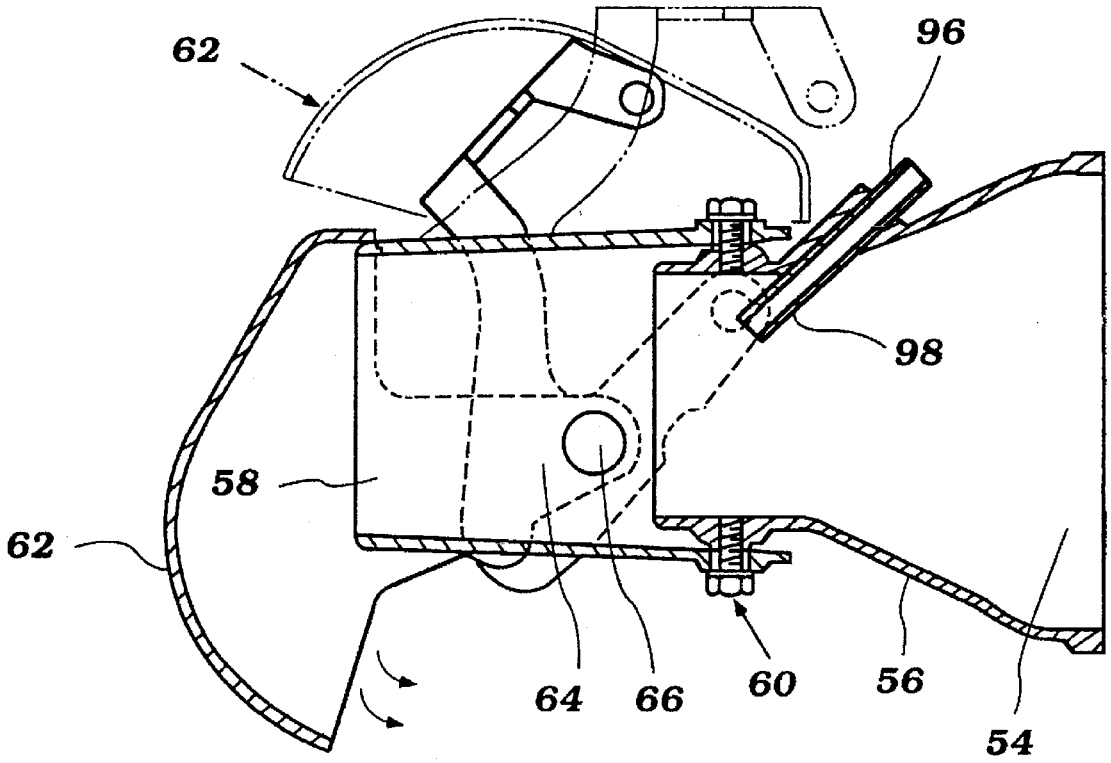
FIG. 3 is a partial cross-sectional view showing the reverse-thrust bucket in its reverse-thrust position.

Referring generally to FIGS. 1–3, a watercraft constructed in accordance with an embodiment of the invention is identified generally by the reference numeral 10. It is to be understood that the type of watercraft depicted is one of many types of watercraft that the invention may be applied to. The invention is particularly adapted for use with watercraft having jet propulsion units, and the type of watercraft illustrated is one that is frequently powered by such propulsion units.

The watercraft 10 is comprised of a hull, indicated generally by the reference numeral 12, that is made up of a lower hull portion 14 and an upper deck portion 16. The hull 12 and deck portion 16 are formed from any suitable material, such as molded fiberglass, reinforced resin, or the like.

The deck portion 16 has a raised pedestal 18 on which a removable tandem seat 20 is positioned. The watercraft 10 is designed for a rider to sit on a front portion 22 of the seat in a straddle-type fashion when operating the watercraft 10. A passenger may sit on a rear portion 24 of the seat in the same fashion as the rider. On opposite sides of the pedestal 18, the deck 16 is provided with a pair of foot areas 26 that terminate at the rear of the watercraft through rear openings (not shown). The rear openings permit water that may enter into the rider's area to drain back out. These openings also facilitate entry of the watercraft 10 from the rear. Raised gunnels (not shown) may be provided and define outer sides of the foot area.

The area of the lower hull portion 14 in front of the seat 20 forms an engine compartment 28 in which a powering internal combustion engine 30 of any known type is positioned. The hull 12 includes a bilge 31 at the bottom of the lower hull portion 14. The engine compartment 28 is accessible through, and sealed off by, the removable seat 20 and a removable hatch cover 32. An opening in the hull 12 for access to the engine compartment 28 is created by removing the seat 20 and hatch cover 32. This opening makes it easy to access components in the engine compartment 28, especially a check valve to be described. The hatch cover 32 is secured to the hull 12 by a latch 34 and supports a handlebar assembly, indicated generally by the reference numeral 36, for control of the watercraft. The handlebar assembly 36 has a pair of spaced apart handgrips 38 for steering the watercraft 10.

A jet propulsion unit 40 is provided below the seat 20 in the lower hull portion 14. The jet propulsion unit 40 is driven by the engine 30 and is separated from the engine 30 by a bulkhead or separator 42. The engine 30 is supported within the engine compartment 28 so that its output shaft 44, normally a crankshaft, rotates about an axis that lies in the longitudinal center plane of the hull 12. This engine output shaft 44 is coupled by means of a resilient coupling, of any known type, to an impeller drive shaft 46. The impeller drive shaft 46 extends rearwardly and is supported at the bulkhead 42 by means of an elastic support, indicated generally by the reference numeral 48. An impeller 50 is fixed to the impeller shaft in a well-known manner.

The elastic support 48 includes a ball bearing construction (not shown) in which the impeller drive shaft 46 is rotatably journaled. The elastic support 48 also includes seals (not shown) for protecting the bearings and for preventing water from entering the engine compartment 28.

The jet propulsion unit 40 has a downwardly facing water inlet 42. Water is drawn by the impeller 50 from the water inlet 42 through a water path 54 and is discharged out a discharge nozzle 56 of the jet propulsion unit 40 for propulsion of the watercraft 10 in a well-known manner.

A steering nozzle 58 is pivotally supported at the end of the discharge nozzle 56 about a vertically extending axis by upper and lower pivot bolts 60. As is well known in this art, pivotal movement of the steering nozzle 58 is effective to change the direction of travel of the watercraft 10. The handlebar assembly 36 is connected to the steering nozzle 58 in any well-known manner for its steering operation.

As shown in FIG. 3, a reverse-thrust bucket 62 has a pair of side portions 64 that are pivotally connected by pivot pins 66 to the steering nozzle 58. The reverse-thrust bucket 62 is movable between a forward drive position, where it is clear of the discharge end of the steering nozzle 58, to a reverse-drive or reverse-thrust position, where the discharge end of the steering nozzle 58 opposes the reverse-thrust bucket 62 so that when water is drawn and pumped by the impeller 50, it will be discharged and reflected off the bucket 62 in a forward direction so as to provide a reverse driving force on the watercraft 10. This reverse driving force causes a retarding operation as well as a reverse operation. Engagement of the reverse-thrust bucket 62 may also be used by an operator to adjust the trim condition of the watercraft 10. Controls are provided for operating the reverse-thrust bucket 62 at the handlebar assembly 36 in a well-known manner in the art.

The watercraft 10 includes a water-removal assembly 68, which constitutes the present invention and will now be described. Water that has accumulated in the bilge 31 of the hull 12 is removed through a water filter 70 provided in the engine compartment 28 adjacent the engine 30 and near the bilge 31. The water filter 70 functions as both a water pickup for the water-removal assembly 68 and a contaminant remover. The water filter 70 removes contaminants from the water, which have collected in the water from the water slushing around in the engine compartment, before discharging the water to the atmosphere or water environment. The water filter 70 is connected, and communicates with, an elbow 72 by a first bilge conduit or pipe 74.

Figure 4:
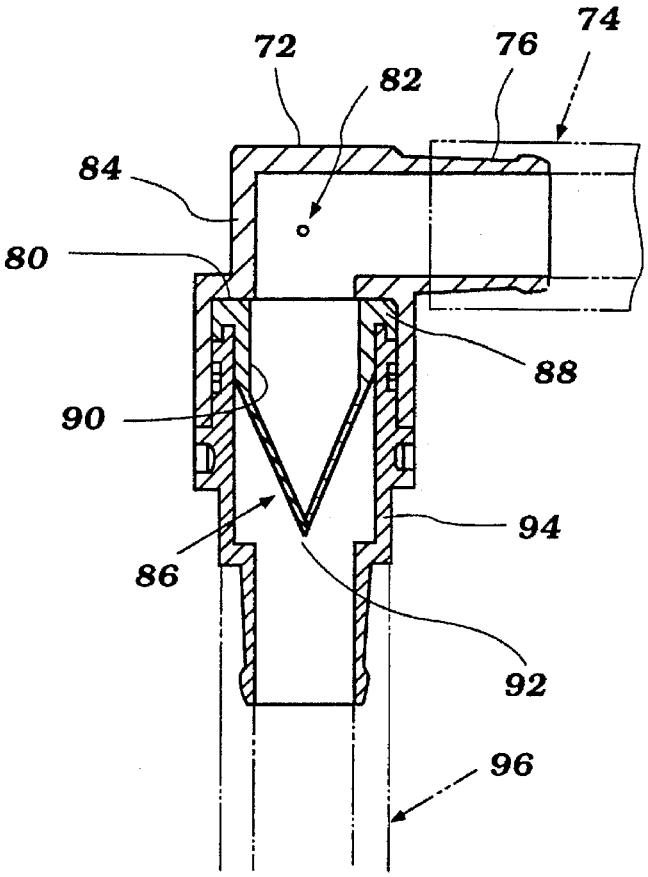
FIG. 4 is a partial cross-sectional view of the check valve and weep hole of the present invention.

As shown in FIG. 4, the elbow 72 includes a cylindrical male inlet 76 and a cylindrical female outlet 78 that extends from an elbow base 80. The first conduit 74 is connected to, and communicates with, the elbow 72 at the male inlet 76. The elbow 72 includes a weep hole 82 at a bend 84 in the elbow 72 for preventing syphoning of water through the water removal assembly 68 and into the engine compartment 28. Operation of the watercraft 10 may provide a suctioning or syphoning effect in the water removal assembly 68. The weep hole 82 prevents a vacuum from forming in the water removal assembly 68 or engine compartment 28 because air can always be sucked through the weep hole 82 into the water removal assembly 68 or engine compartment 28. The suctioning or syphoning effect occurs because of the pressure differences created by the vacuum. Thus, the weep hole 82 prevents syphoning of water into the engine compartment 28.

Figure 5:
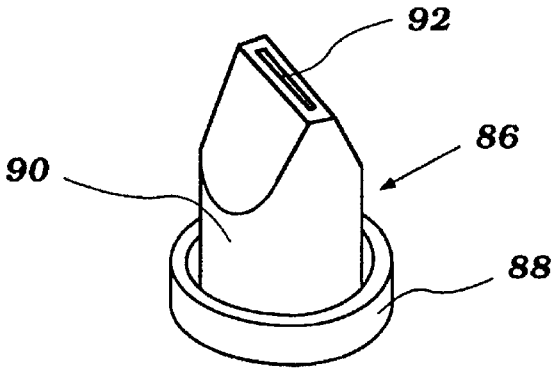
FIG. 5 is a perspective view of the check valve of the present invention.

A duck-bill valve, or check valve 86, is mounted in the female cylindrical outlet 78 adjacent the base 80 of the elbow. As shown in FIG. 5, the check valve 86 includes a cylindrical collar 88 and a tapered cylindrical portion 90 that extends therefrom. At an end of the check valve 86 opposite to the collar 88 where the tapered cylindrical portion 90 terminates, a one-way slit 92 is provided.

The construction of the check valve 86 allows water to exit the check valve 86 through the one-way slit 92, but substantially prevents water from entering it, providing water flow in substantially one direction. Thus, water may be pumped from the engine compartment 28 through the check valve 86 so that water exits the check valve 86, but water is substantially prevented from entering the check valve 86 from the opposite direction.

A connecting piece 94 is mounted between the outer perimeter of the check valve 86 and the inner perimeter of the female outlet 78 of the elbow 72. The connecting piece 94 connects and communicates the elbow 72 and check valve 86 with a second bilge conduit or pipe 96.

As shown in FIGS. 1 and 2, the conduits 74 and 96 form a substantially U-shaped portion in which the check valve 86 is located. The construction of this U-shaped portion provides additional protection against water entering the engine compartment 28.

The second bilge conduit 96 includes a bilge outlet portion 98 that extends through the discharge nozzle 56 to a water discharge point downstream of the impeller 50. The location of the bilge outlet 98 at an appropriate point in the jet unit 40 allows water to flow past the bilge outlet 98, causing a suction or syphoning effect so that water is pumped from the bilge 31 of the engine compartment 28, through the water-removal assembly 68, and into the jet unit 40. The bilge conduits may be constructed of a flexible or rigid material. However, bilge conduits that are constructed of a flexible material may make it easier to assemble the water-removal assembly 68 into the hull 12 of the watercraft 10.

It will be readily apparent to those skilled in the art that the number of conduits used in the water removal assembly may be varied without detracting from the spirit and scope of the invention. Also, other pumping arrangements may be provided to form a venturi pump similar to the one mentioned above, or other pumping means may be provided for pumping water from the bilge of the engine compartment 28.

As mentioned above, a syphoning effect may occur through the water-removal assembly 68 so that water is drawn from the discharge nozzle 56 into the engine compartment 28. Additionally, the engagement of a reverse-thrust bucket 62 may cause some water to be forced back into the discharge nozzle 56. When this occurs, water may be forced into the water-removal assembly 68 and into the engine compartment 28. The construction of the water-removal assembly 68 is not only designed to prevent both of the above problems, but any other situation in which water has a tendency to flow into the hull 12 through the water-removal assembly 68.

It is to be understood that the foregoing description is that of a preferred embodiment of the invention and that various changes and modifications may be made without departing from the spirit and scope of the invention, as defined by the appended claims.

What is claimed is:

1. A water-removal assembly for removing water from a bilge of a watercraft that includes a removable seat, said water-removal assembly comprising a pumping device, at least one conduit communicating said bilge with said pumping device so as to remove water from said bilge, an inverted substantially U-shaped portion formed by said at least one conduit, a backflow prevention device provided in said U-shaped portion, an access opening provided below said removable seat, said backflow prevention device including a check valve that is easily accessible through said access opening and allows water to be removed from said bilge but substantially prevents water from entering said bilge.

2. The water-removal assembly of claim 1, wherein said watercraft includes a jet propulsion unit having an impeller, said pumping device provided by communicating said at least one conduit to a water discharge point downstream of said impeller so that water is pumped from said bilge.

3. The water removal assembly of claim 1, wherein said substantially U-shaped portion forms the highest portion in said at least one conduit.

4. The water removal assembly of claim 1, wherein said backflow prevention device includes a pin hole that prevents water for siphoning into said bilge.

5. The water removal assembly of claim 1 wherein said check valve includes a cylindrical portion, a cylindrical collar is provided at one end of said cylindrical portion and surrounds said cylindrical base, a tapered portion is provided at an opposite end of said cylindrical portion, a slit is provided at an end of said tapered portion.

6. The water-removal assembly of claim 4, wherein an elbow includes two extensions and a bend where the two extensions join, the check valve is provided in one of said extensions and the pin hole is provided in the bend of the elbow.

* * * * *